US007654115B2

(12) United States Patent
Duckham et al.

(10) Patent No.: US 7,654,115 B2
(45) Date of Patent: Feb. 2, 2010

(54) TUBULAR KNIT BRA

(75) Inventors: Jadideah Duckham, Atlanta, GA (US); Brian S. Adams, High Point, NC (US); Billie J. Willis, Asheboro, NC (US)

(73) Assignee: Spanx, Inc., Atlanta, GA (US)

( * ) Notice: Subject to any disclaimer, the term of this patent is extended or adjusted under 35 U.S.C. 154(b) by 1240 days.

(21) Appl. No.: 10/936,089

(22) Filed: Sep. 8, 2004

(65) Prior Publication Data

US 2006/0048547 A1 Mar. 9, 2006

(51) Int. Cl.
*D04B 7/32* (2006.01)

(52) U.S. Cl. ..... 66/176

(58) Field of Classification Search ..... 66/175, 66/176, 196, 197; 450/65, 39, 92, 40
See application file for complete search history.

(56) References Cited

U.S. PATENT DOCUMENTS

| | | | | | |
|---|---|---|---|---|---|
| 1,502,160 | A * | 7/1924 | Reinthal | 2/172 |
| 1,984,326 | A * | 12/1934 | Titone | 66/176 |
| 3,184,758 | A * | 5/1965 | Hirsch | 2/209 |
| 3,537,279 | A * | 11/1970 | Epley | 66/176 |
| 3,772,899 | A | 11/1973 | Novi | 66/176 |
| 4,453,549 | A * | 6/1984 | DiTullio | 450/74 |
| 4,531,525 | A | 7/1985 | Richards | 128/489 |
| 5,850,745 | A | 12/1998 | Albright | 66/176 |
| 5,944,579 | A | 8/1999 | Fleischman | 450/69 |
| 6,015,331 | A * | 1/2000 | Ioakim | 450/37 |
| 6,125,664 | A * | 10/2000 | Browder, Jr. | 66/176 |
| 6,178,784 | B1 | 1/2001 | Marley, Jr. | 66/173 |
| 6,227,011 | B1 | 5/2001 | Cortinovis | 66/171 |
| 6,287,168 | B1 * | 9/2001 | Rabinowicz | 450/75 |
| 6,805,610 | B2 * | 10/2004 | Luk | 450/54 |
| 6,824,445 | B2 * | 11/2004 | Oneyear et al. | 450/70 |
| 6,863,589 | B2 * | 3/2005 | Cano | 450/65 |

* cited by examiner

*Primary Examiner*—Danny Worrell
(74) *Attorney, Agent, or Firm*—K&L Gates LLP

(57) ABSTRACT

A knitted fabric bra formed of a length of circular knit material flattened into a double ply fabric with ends secured together to form a torso encircling main body portion having rounded top and bottom edges. A pair of lengths of circular knit material flattened into double ply fabrics have ends secured to the main body portion to form shoulder straps having rounded side edges. The main body portion has a pair of enlarged, relatively loosely knit, relatively highly resiliently stretchable breast pockets. Under-sections are formed below the breast pockets. A front section extends between the breast pockets. Side sections extend from the breast pockets and are connected by a back section. The yarn selection and stitch size are varied in knitting of the fabric to provide desired fabric characteristics.

30 Claims, 7 Drawing Sheets

TUBULAR KNIT BRA

FIELD OF THE PRESENT INVENTION

The present invention relates to bras made of tubular knit fabric, and more particularly to bras made of tubular knit fabric flattened into a two ply fabric.

BACKGROUND OF THE PRESENT INVENTION

Bras of knitted fabric are known for use particularly as sports bras worn during physical activity because of their inherent stretchability and resulting body conformability. Because of the comfort of such bras, their use is not limited only to wear during physical activities, but are desirable and advantageous for general use as well.

Conventional knitted bras may be formed of circular knit tubes with the circumference of the tubes extending around the torso of the wearer, or the tube being flattened and cut to form integral shoulder straps and folded to form front and rear bra portions that are secured together at side seams. In either case, time consuming and expensive cutting and sewing operations are required, resulting in an expensive waste of cut away material. Also, importantly, shoulder straps are either formed from separate pieces of edging or ribbons of fabric having ends secured to the main body portion, or the tube is knit of sufficient height to provide material for integral strap portions, resulting in an additional waste of material. Further, uncomfortable and conspicuous edge binding material or ribbons are conventionally required to cover the edges of the main body portion and the edges of the shoulder straps.

There are also tubular knit bras which are formed of flattened knit tubes with ends sewn or connected to form a body encircling two ply fabric. An illustration of this type of bra is disclosed in Novi U.S. Pat. No. 3,772,899, which discloses breast pocket portions formed by distending the fabric by forming and stabilizing by heat and pressure. The disclosed bra is strapless or, alternatively, has conventional shoulder straps secured to the main body portion. Another example of a strapless circular knit bra is disclosed in Albright U.S. Pat. No. 5,850,745, which discloses a tubular knit fabric that is slit axially to form two separate single ply bras that extend around the torso of the wearer with breast pocket peripheries formed of elastic fabric. This patent also discloses a single ply tubular knit strapless bra with its axis extending vertically of the wearer and with edges knit with turned welts.

While the prior art discloses tubular knit bras that are flattened to form a two ply fabric that encircles the body of the wearer, such prior art bras either are strapless or utilize conventional narrow, relatively hard, shoulder straps and are not knit in a varying pattern that provides any different structural fabric characteristics in different areas of the bra for advantageous fitting characteristics, except for the breast pocket areas.

SUMMARY OF THE PRESENT INVENTION

Briefly described, the tubular knitted fabric bra of the present invention is formed from a length of circular knit material flattened into a double ply fabric having ends secured together to form a body encircling main bra portion having rounded top and bottom edges. Shoulder straps are formed of a pair of lengths of circular knit material flattened into double ply fabrics having ends secured to the main bra portion and having rounded side edges. This results in a bra that can be rapidly and inexpensively produced with the resulting garment being free of any uncomfortable and unsightly edging strips either on the main body portion or on the shoulder straps, and the shoulder straps can be sufficiently wide, which in combination with the absence of edging material provides comfort without digging into the shoulders of the wearer, which is particularly advantageous when the bra is worn during physical activities.

Being tubular knit with the axis of the tube encircling the torso of the wearer, a relatively narrow tube can be knit. Therefore, the fabric can be rapidly and inexpensively knit using hosiery knitting machines. The fabric is made of elastic yarn with the knitting pattern being variable to produce desirable stretchable and relatively non-stretchable sections in the fabric to suit desired characteristics in the finished bra. For example, the main bra portion may be formed with a pair of enlarged, relatively loosely knit, relatively highly resiliently stretchable breast pockets, which may be formed in both plies of the double ply bra fabric. To provide uplifting support without the need for additional material or inserts, relatively tightly knit, relatively non-stretchable sections may be provided along the bra below the breast pockets. Advantageously, the ends of the shoulder straps are flared outwardly to ends secured to the main body portion at the breast pockets to form continuations of the breast pockets. Further, support of the breast pockets can be enhanced by having the lower areas of the breast pockets slightly more tightly knit and less resiliently stretchable than the upper areas of the breast pockets.

To provide form fitting stability with desired stretchability, side sections may be formed in the bra of relatively tightly knit, relatively non-stretchable areas extending from the breast pockets to a moderately loosely knit, moderately resiliently stretchable back section. Preferably, the side sections have relatively tightly knit, relatively non-stretchable, pronounced ribbed fabric areas extending from adjacent the breast pockets and tapering rearwardly and downwardly to form complementary tapered areas of relatively lesser tightly knit fabric. These areas provide desired form fitting support in the bra.

The ends of the tubular knit fabric are secured together between the breast pockets, where the sewn seam will be of little or no discomfort to the wearer.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENT

Figure 1:
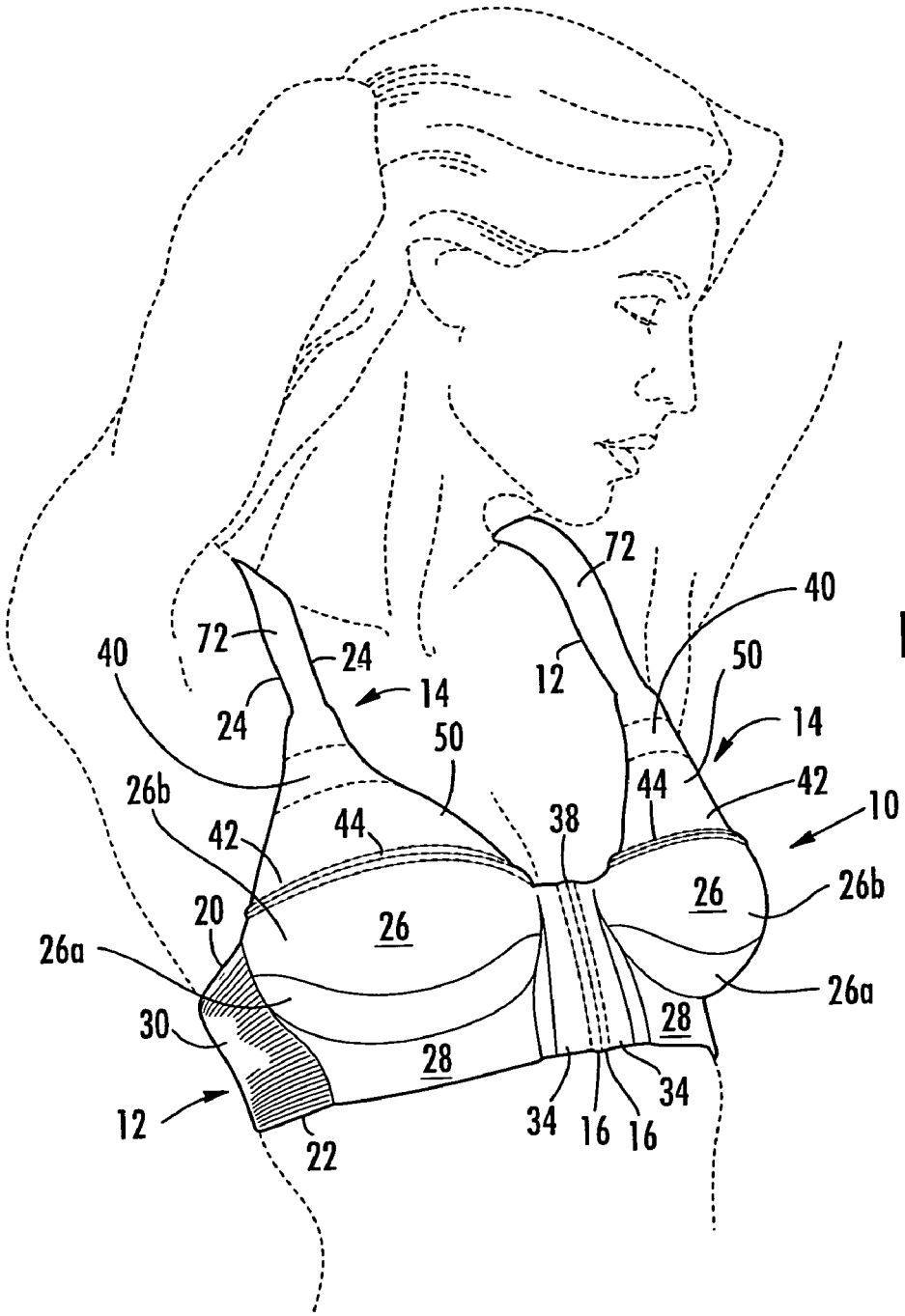
FIG. 1 is a front perspective view of the bra of the preferred embodiment of the present invention illustrated on the body of a wearer.
Figure 2:
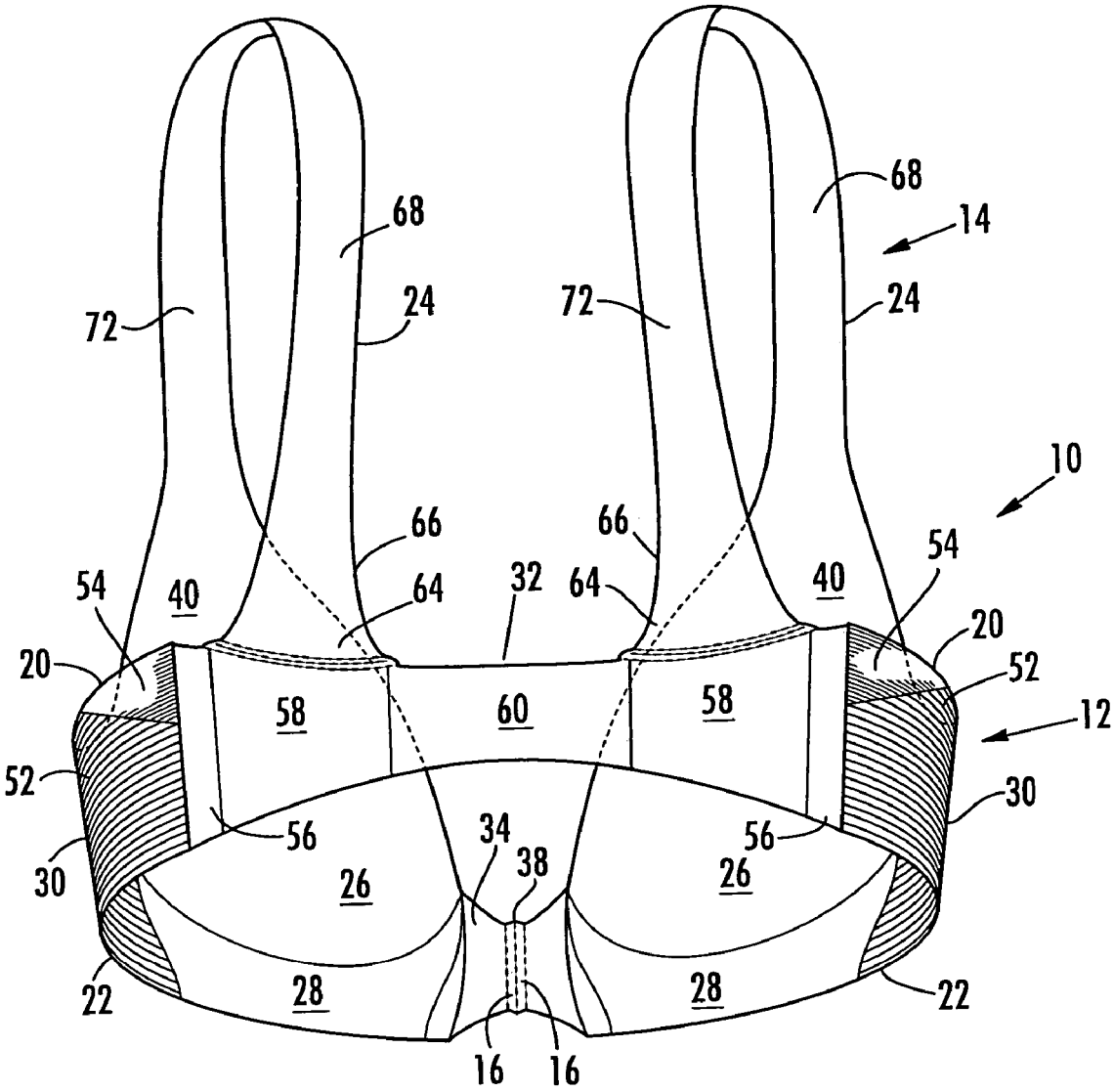
FIG. 2 is a rear perspective view of the bra of FIG. 1 as it appears on a wearer.

As illustrated in the accompanying drawings, the knitted fabric bra 10 of the preferred embodiment of the present invention has a tubular knit main body portion 12 and a pair of tubular knit shoulder straps 14. It is knit of elastic yarn, such as a nylon wrapped spandex core yarn.

The main body portion 12 is formed from a tubular length of circular knit material 18 (FIG. 6), with the length 18 forming a torso encircling main body portion 12. Being circular knit flattened fabric, the main body portion 12 has rounded top and bottom edges 20, 22, respectively, such that no edging or other strips are necessary to cover edges that are formed in prior art bras when cutting material to the shape of the bra from woven material or from single ply tubular knit material or two ply material where the axis of the tube is vertical with respect to the wearer. The resulting smooth edges avoid the uncomfortable, irritating and unsightly edges of bras that are particularly disadvantageous when the bra is worn during physical activity.

The shoulder straps 14 are similarly formed from a pair of lengths of circular knit material flattened into double ply fabrics that form relatively wide shoulder straps with the vertical axis of the lengths of material extending vertically with respect to the wearer, resulting in side edges 24 formed by the folded edges of the lengths of material, which, like edges 20, 22 of the main body portion 12, require no edging or other strip material on the edges, thereby avoiding the discomfort, irritation and unsightliness of conventional shoulder straps, which advantage is enhanced by the shoulder straps 14 being of sufficient width to avoid digging into the shoulders of the wearer.

As illustrated in the preferred embodiment, the main body portion 12 has a pair of enlarged, relatively loosely knit, relatively highly resiliently stretchable breast pockets 26 that are resiliently stretchable to comfortably contain and support the breasts of the wearer without requiring stretching of the adjacent sections of the main body portion 12. These breast pockets 26 are formed in both plies of the double ply bra fabric. The outer ply has lower areas 26*a* of slightly tighter knit fabric than the upper areas 26*b* to enhance breast pocket support. These slightly tighter knit lower areas 26*a* may also be formed on the inner ply, or both plies may be knit with the fabric of the upper areas 26*b* extending throughout the breast pockets 26, to provide different shapes and sizes as desired.

To provide form and support for the breast pockets 26, relatively tightly knit, relatively non-stretchable under-sections 28 are provided below the breast pockets 26 in the main body portion 12.

To provide form fitting characteristics to the main body portion 12, relatively tightly knit, relatively non-stretchable side sections 30 extend from the breast pockets 26 to a moderately loosely knit, moderately resiliently stretchable back section 32 that extends between and is connected to the two side sections 30 across the back of the wearer.

The side sections 30 have areas 52 of pronounced tightly knit ribbed fabric that extend the full height of the side sections 30 adjacent the breast pockets 26 and for a portion of the lengthwise extent of the side sections 30, and then taper rearwardly and downwardly to define complementary tapered areas 54 of lesser tightly knit ribbed fabric thereabove. These areas 52 and 54 provide desired relative form fitting support in the bra 10.

Between the breast pockets 26 there is a moderately loosely knit, moderately resiliently stretchable, relatively short, front section 34, which serves to connect and vertically gather the material of the breast pockets 26. In the center of the front section 34, the ends 16 of the length of material forming the main body portion 12 are sewn together by a seam 38 to close the length of material into an endless circular loop. This location of the seam 38 in the front section 34 minimizes irritation and discomfort in comparison with a seam located in the sides or back where relative movement of the skin of the wearer with respect to the bra would be more pronounced.

The circular knit flattened double ply shoulder straps 14 have front sections 40 that flare outwardly substantially in width to ends 42 that are sewn to the top of the breast pockets 26 of the main body portion 12 in a seam 44. These front sections 16 of the shoulder straps 14 advantageously provide upper continuations of the breast pockets 26. The shoulder straps 14 have back ends 64 sewn to the back section 32 of the main body portion 12, with the shoulder straps slightly inwardly flaring from the ends 64 to relatively wide straight sections 68. These sections 68 extend to near the center of the shoulder straps, at which the shoulder straps taper inwardly, as illustrated at 70, to a somewhat narrower straight section 72, from which the length 48 flares outwardly substantially to form the aforesaid front sections 40 that terminate in the front ends 42.

Figure 3:
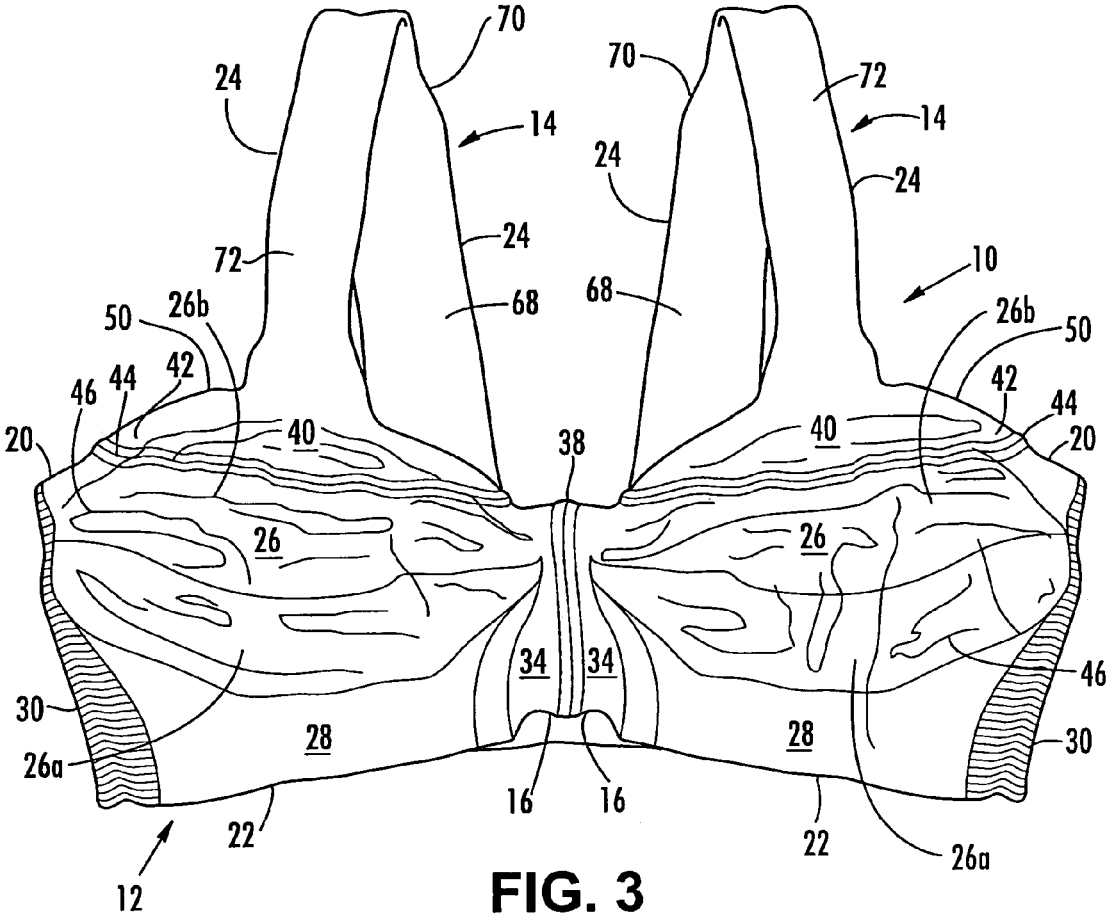
FIG. 3 is a front elevation of the bra of FIG. 1 shown in its unworn, relaxed condition.
Figure 4:
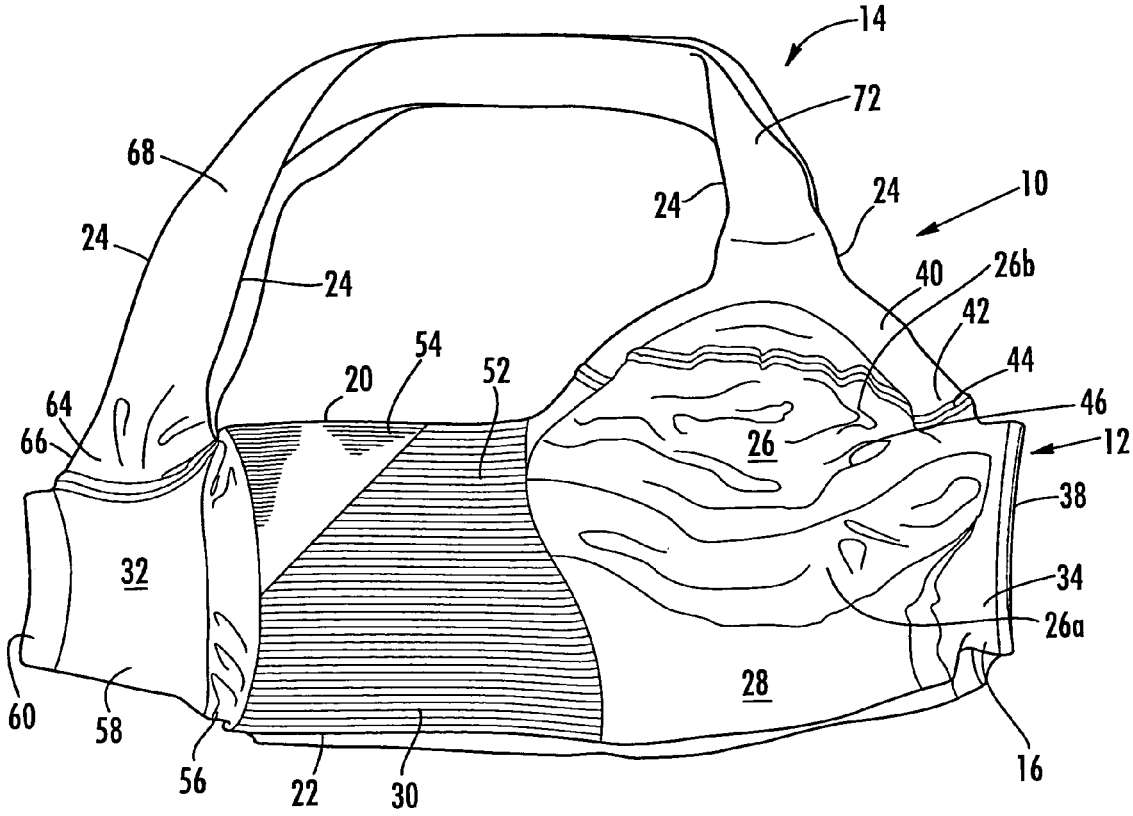
FIG. 4 is a side elevation of the unworn, relaxed bra of FIG. 3.
Figure 5:
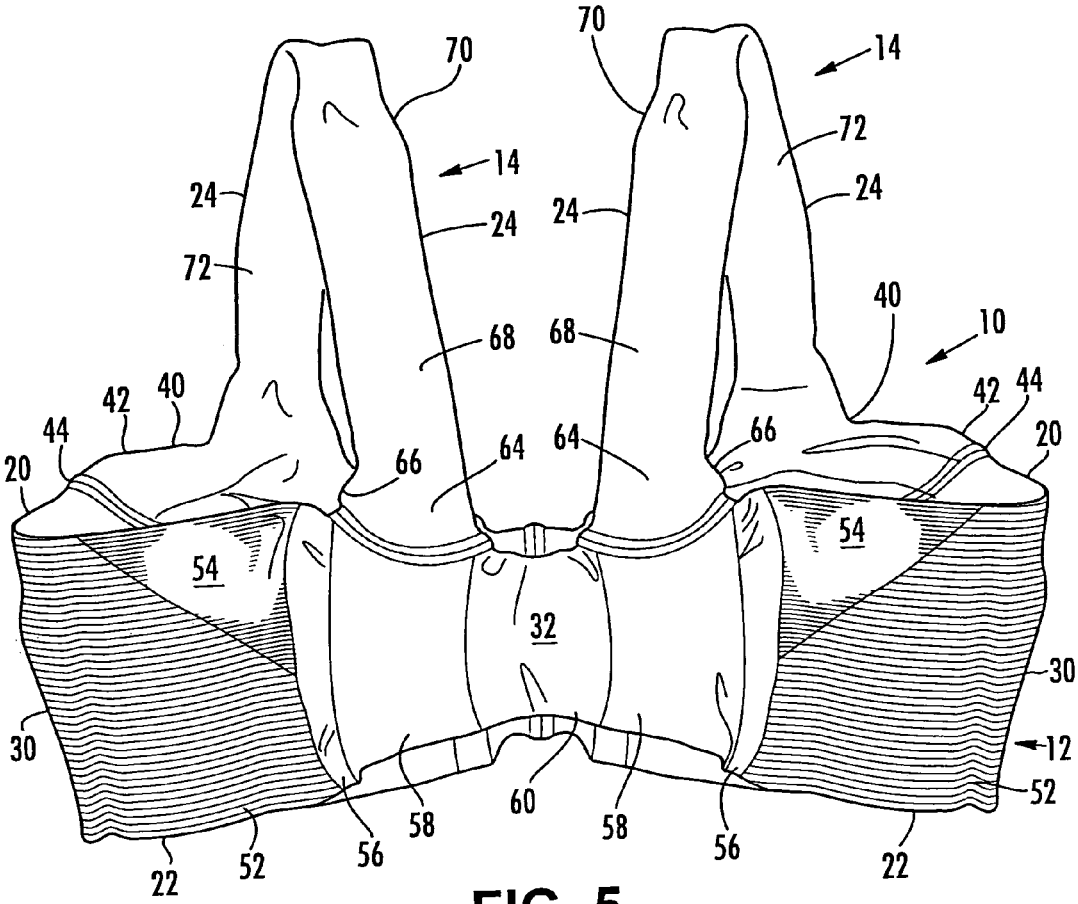
FIG. 5 is a rear elevation of the unworn, relaxed bra of FIG. 3.

FIGS. 3, 4, and 5 illustrate the bra 10 in its relaxed, unworn condition, illustrating, in particular, the gathered folds 46 in the breast pockets 26 that provide the fabric that is stretched when worn to contain and support the breasts of the wearer.

Figure 6:
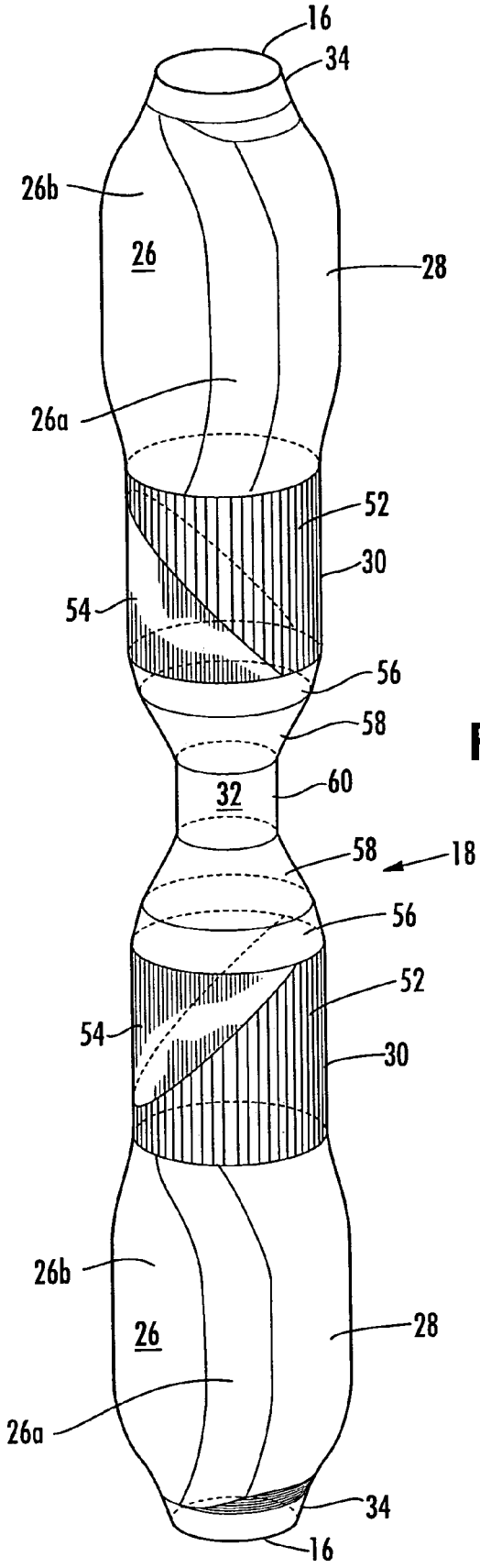
FIG. 6 is an illustration of a length of tubular knit fabric in tubular form as knit on a circular knitting machine prior to being flattened to form the main body portion of the bra of FIG. 1.

The length 18 of circular knit material in the form of a tube in which it is knit prior to being flattened to form the main body portion 12 is illustrated in FIG. 6. The end 16 at the bottom of the figure is the first portion to be knit. Knitting then progresses through the adjacent part of the front section 34, which is moderately loosely knit and moderately resiliently stretchable. This part of the front section 34 is relatively short. The front section 34 flares somewhat outwardly, as indicated at 50, where it is followed by the breast pocket 26 and the relatively tightly knit, relatively non-stretchable under-section 28 that begins at almost the full height of the breast pocket 26 at the juncture with the front section 34 and curves to result in an enlargement of the breast pocket 26 with the breast pocket 26 and under-section 28 being knit simultaneously, the breast pocket being relatively loosely knit, relatively highly resiliently stretchable fabric that is gathered in folds 46 when relaxed, and has a lower area 26*a* slightly tighter knit than the upper area 26*b*. The simultaneous knitting of the breast pocket 26 and under-section 28 continues with the under-section 28 then increasing in size with the breast pocket 26 decreasing correspondingly to provide curvature of the ultimate underside of the breast pocket 26 to a point where the knitting of the breast pocket 26 and under-section 28 is completed.

Knitting then progresses through the side section 30, which is relatively tightly knit and relatively non-stretchable, beginning with a pronounced ribbed fabric area 52 that extends continuously around the length 48 through a first area of the side section 30 and then tapers to a reduced circular extent in combination with a complementary relatively lesser ribbed fabric area 54 of slightly lesser tightly knit fabric to form the complete side section 30.

Following the knitting of the side section 30, knitting of the tubular length 48 continues with the knitting of the back section 32, which begins with a short transition portion 56 that tapers slightly inwardly to an intermediate portion 58 to a slightly narrowed middle portion 60.

Knitting then continues in the reverse order and is completed when the upper end 12 of the length of material 18 is knit and the length of material 18 is removed from the knitting machine. The ends 16 of the length 18 of material are then sewn together to form the main body portion 12.

Figure 7:
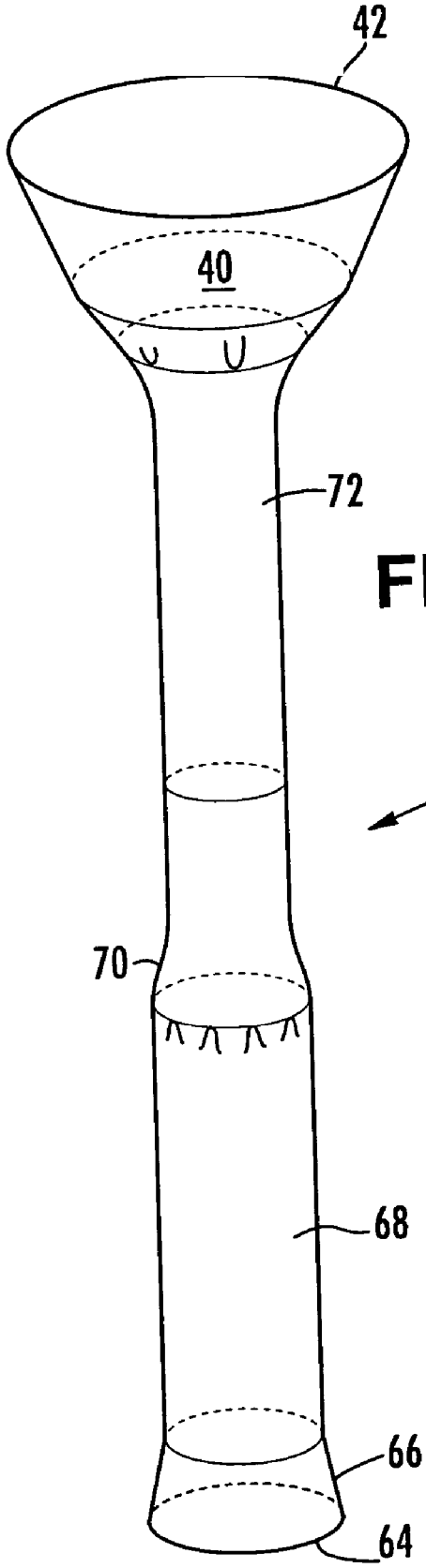
FIG. 7 is an illustration of a length of tubular knit fabric in tubular form as knit on a circular knitting machine prior to being flattened to form the shoulder strap of the bra of FIG. 1.

One length 48 of circular knit material that forms a shoulder strap 14 is illustrated in FIG. 7. The front end 42 of the length 48 is seen at the top of FIG. 7. This is the end that is sewn to a breast pocket 26 of the main body portion 12 and is relatively wide so as to form a connection with the breast pocket 26 from which knitting continues at a substantial inward tapering to form the outward flaring front section 40 as a continuation of the breast pocket 26. This is followed by knitting of a relatively narrow straight portion 72 that initially continues the inward tapering from the front section 40 to a narrow straight width. Following the relatively narrow straight section 72, the knitting continues with an outward flaring, at 70, to a relatively wider straight section 68, from which knitting continues to form a slightly outward flaring rear section 66, to an end 64 that will be connected to the back section 32 of the main body portion 12.

After the tubular length 18 of the main body portion and the tubular lengths 48 of the shoulder straps 14 are knit, they are flattened. The shoulder straps 14 are then sewn to the length 18 of the main body portion material and the ends 16 of the length 18 are then sewn together to complete the bra 10. Alternatively, the ends 16 of the tubular length 18 may be sewn together first, to complete the main body portion 12 and then the ends 42 and 64 of the shoulder straps 14 may be sewn at the front to the breast pockets 26 and at the rear to the back section 32 to complete the bra 10.

The comparative words "relatively" and "moderately" as used herein are to be understood to mean the relation of the characteristics of one section or area of the bra 10 in comparison with other sections and areas.

In a preferred embodiment of the present invention the entire bra 10, i.e., both the main body portion 12 and the shoulder straps 14, is knit on a 400 needle, 4 feed, 4 inch cylinder hosiery knitting machine, such as a Matec HF 4.7 VM (Variable Movement, i.e., the stitch cam is controlled to go in and out and up and down) using a stretch yarn having a spandex core covered by a textured stretch nylon filament yarn wrapped around the core.

In the following description and claims, the yarn designation "--/--/--" designates the denier of the spandex core/the denier of the textured stretch nylon filament yarn cover/and the number of filaments in the nylon cover yarn. The dimensions recited are the approximate dimensions of the fabric in relaxed state. The following description applies to the knitting of a typical size 34, C or D cup, bra with the dimensions and stitch heights in each section or area being variable to suit different bra sizes and cups.

With reference to FIG. 6, knitting of a preferred embodiment of the tubular length of circular knit material 18 that forms the main body portion 12 having a relaxed length of about 55 mm. begins by knitting the initial makeup at the end 16, which is knit with a 1×1 alternate needle selection, using two feeds, with one end of 20/30/34 yarn in each feed at a stitch height of 1.5 mm.

The front section 34 is then knit with 1×1 alternate positive needle selection using two feeds with two ends of 20/30/34 in each feed and progressing for approximately 1 mm. from a stitch height of 1.5 mm. to a stitch height of 2.0 mm.

Knitting then progresses with the simultaneous knitting of the under-section 28 and the breast pocket 26, including the lower section 26*a* and upper section 26*b*, for approximately 12 mm., varying from 10 to 12 mm. from bottom to top in relaxed state due to the different stretch characteristics of the sections. The under-section 28 is knit in a 1×1 alternate tuck using two feeds with 3 ends of 20/70/72 in each feed and a stitch height of 0.5 mm. The breast pocket 26 is knit in a jersey knit using two feeds. The lower area 26*a* of the breast pocket is knit with three ends of 20/70/72 yarn in each feed at a stitch height of 2.5 mm. The inside ply of area 26*a* is knit with 1 to 3 ends of yarn in each feed, depending on the size of the garment to provide a desired fit and form. The upper area 26*b* is knit with one end of 20/70/72 yarn in each feed and a stitch height of 1.5. mm. Starting at the juncture with the front section 34, the first course of the under-section 28 and breast pocket areas 26*a* and *b* is knit with the under-section 28 extending through about one-half of the circumference of the tube 18, the outer ply of the under area 26*a* is knit through approximately one-eighth of the circumference of the tube 18, the upper area 26*b* is knit through about one-quarter of the circumference of the tube 18 and the inner ply of the lower area 26*a* is knit through about one-eighth of the circumference of the tube 18. Knitting then progresses with the under-section 28 decreasing coursewise through about one-third of the length of the sections to an extent of approximately three-sixteenths of the circumference of the tube 18 and the upper area 26*b* increasing to an extent of approximately nine-sixteenths of the circumference of the tube 18. Each ply of the under area 26*a* remains extending approximately one-eighth of the circumference of the tube 18 throughout the entire section. Knitting then continues without change for approximately another third of the length of the sections, after which the under-section 28 increases for the remaining one-third of the sections to approximately nine-sixteenths of the circumference of the tube 18, and the upper section 26*b* decreases to approximately three-sixteenths of the circumference of the tube 18.

Knitting then continues with the knitting of the fabric of the side section 30, which extends approximately 10 mm., beginning with the tightly knit pronounced ribbed fabric 52 in a 2×2 clear float needle selection using two feeds with 3 ends of 20/70/72 yarn in each feed and a stitch height of 2.0 mm. This continues over the full circumference of the tube 18 for approximately one-quarter of the length of the side section 30. From that point on, knitting progresses with the number of needles knitting the pronounced rib fabric 52 decreasing for the remaining three-quarters of the length of the side section to a point at which the back section 32 will be knit, at which point the pronounced ribbed fabric 52 will extend over approximately one-quarter of the circumference of the tube 18. As this tightly knit fabric 52 is being knit in this taper, the relatively lesser tightly knit fabric 54 begins and increases from the point at which the tightly knit fabric 52 begins tapering to the point at which the back section 32 begins, at which the relatively lesser tightly knit fabric 54 extends over approximately three-quarters of the circumference of the tube 18. This relatively lesser tightly knit fabric 54 is knit in a 1×1 clear float needle selection using two feeds with 3 ends of 20/70/72 yarn in each feed and a stitch height of 2.0 mm.

Knitting of the back section 32 begins with the knitting of the short transition portion 56, which is jersey knit with two feeds of one end of 20/70/72 in each feed and decreasing from a stitch height of 2.0 mm. to 1.0 mm. over approximately one-tenth of the length of the back section 32, which is approximately 14 mm. in length. The intermediate portion 58 is then knit in a 1×1 alternate positive needle selection on one feed and a jersey needle selection on a second feed, with one end of 20/70/72 yarn in each feed, beginning with a needle height of 1.0 mm. and decreasing over approximately one-quarter of the length of the back section 32 to 0.5 mm. The middle portion 60 of the back section 32 is then knit with a 1×1 alternative positive needle selection using 1 end of 20/70/72 in each feed at a needle height of 0.5 mm. over approximately three-tenths of the length of the back section 32.

Knitting then continues by knitting an identical reverse intermediate portion 58 and transition portion 56, and a reverse of the above described sequence of knitting of sections and areas to complete the knitting of the length of material 18 to form the body portion 12.

With reference to FIG. 7, knitting of a preferred embodiment of the length of circular knit material 48 that forms a shoulder strap 14 of a relaxed length of approximately 28 mm. begins by knitting of the make-up front end 42, which is knit in a 1×1 positive needle selection on all four feeds with one end of 20/70/72 yarn in each feed at a stitch height of 2.5 mm. Knitting then continues to knit the tapered front section 40 with a 1×1 positive needle selection on two feeds and a jersey knit needle selection on two other feeds using one end of 20/70/72 yarn in each of the four feeds, and with the stitch height decreasing from 2.5 mm. to 2.0 mm., over a length of approximately one-eighth of the length of the shoulder strap material 48.

Knitting then continues, knitting the relatively narrow straight section 72 with a 1×1 random needle selection at all four feeds with an end of 20/23/28 yarn at each feed, at a stitch height decreasing initially from 2.0 to 0.5 mm. and then continuing at the 0.5 mm. stitch height over a length of approximately one-half of the length of the shoulder strap material 48.

The wider straight section 68 is then knit with a 1×1 and a 1×3 alternating positive needle selection on all four feeds using the same 20/23/28 yarn in each feed at a stitch height of 0.5 mm. This results in a slight outward flaring, at 70, in the transition from the relatively narrow section 72 to the relatively wider section 68, which continues at the 0.5 mm. stitch height for approximately one-quarter of the length of the shoulder strap material 48. This is then followed by an increase of the stitch height from 0.5 to 1.5 mm. over approximately one-eighth of the length of the shoulder strap material 48 to form the rear section 66, ending at the rear end 64 of the length of material 48.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed:

1. A knit fabric bra comprising a length of circular knit material flattened into a double ply fabric having ends secured together to form a torso encircling main body portion having rounded top and bottom edges, a pair of lengths of circular knit material flattened into double ply fabrics having ends secured to said main body portion to form shoulder straps having rounded side edges, said main body portion having a pair of enlarged, relatively loosely knit, relatively highly resiliently stretchable breast pockets, relatively tightly knit, relatively non-stretchable under-sections below said breast pockets, and said breast pockets having ends, and said under-sections tapering from a greater extent adjacent the ends of the breast pockets to a lesser extent therebetween and said breast pockets increasing in extent between said ends.

2. The knitted fabric bra of claim 1 characterized by said tapering of said under-sections extending for about one-third of the length of the breast pockets and extending substantially without change therebetween.

3. The knitted fabric bra of claim 2 characterized by a front section and side sections with said breast pockets and under-sections extending between said front section and said side sections, said under-section being about one-half the circumference of said flattened circular knit material at said center section and tapering to approximately three-sixteenths of the circumference and decreasing from nine-sixteenths of the circumference at said side sections to three-sixteenths of the circumference.

4. The knitted fabric bra of claim 3 characterized by said breast pockets increasing and decreasing in circumferential extent complementary to the decreasing and increasing of the circumferential extent of said under-sections.

5. The knitted fabric bra of claim 4 characterized by said under-sections having three ends of yarn in each stitch knit at a stitch height of 0.5 mm.

6. The knitted fabric bra of claim 5 characterized by the stitches of under-sections being alternate tuck stitches.

7. The knitted fabric bra of claim 6 characterized by said breast pockets being formed of jersey knit stitches.

8. The knitted fabric bra of claim 3 characterized by said double ply fabric having an outer ply and an inner ply, and said breast pockets of at least one of said plies having an upper area and a lower area, said lower area being slightly more tightly knit and less resiliently stretchable than said upper area, said lower area being of constant circular extent throughout said breast pockets.

9. A knit fabric bra comprising a length of circular knit material flattened into a double ply fabric having ends secured together to form a torso encircling main body portion having rounded top and bottom edges, a pair of lengths of circular knit material flattened into double ply fabrics having ends secured to said main body portion to form shoulder straps having rounded side edges, said main body portion having a pair of enlarged, relatively loosely knit, relatively highly resiliently stretchable breast pockets, relatively tightly knit, relatively non-stretchable side sections extending from said breast pockets, and said side sections having relatively tightly knit, relatively non-stretchable pronounced ribbed fabric areas extending from adjacent said breast pockets and tapering rearwardly and downwardly to form complementary tapered areas of relatively lesser tightly knit ribbed fabric thereabove.

10. The knitted fabric of claim 9 characterized by said tightly knit pronounced ribbed fabric being knit in a 2×2 clear float needle selection with three ends of yarn in each stitch and a knit stitch height of 2.0 mm., said pronounced ribbed fabric extending throughout the circumferential extent of said material from said breast pockets approximately one-quarter of the length of the side sections, said pronounced ribbed fabric decreasing in circumferential extent for the remaining approximately three-quarters of the length of the side sections to said back section at which said pronounced ribbed fabric extends approximately one-quarter of the circumferential extent of the material, said relatively lesser tightly knit ribbed fabric is knit in a 1×1 clear float needle selection with three ends of yarn in each stitch and a knit stitch height of 2.0 mm.

11. A knit fabric bra comprising a length of circular knit material flattened into a double ply fabric having ends secured together to form a torso encircling main body portion having rounded top and bottom edges, a pair of lengths of circular knit material flattened into double ply fabrics having ends secured to said main body portion to form shoulder straps having rounded side edges, said main body portion having a pair of enlarged, relatively loosely knit, relatively highly resiliently stretchable breast pockets, a moderately loosely knit, moderately resiliently stretchable back section, and said back section having short transition portions adjacent said side sections, intermediate portions adjacent said transition portions, and a middle portion between said intermediate portions.

12. The knitted bra of claim 11 characterized by said transition portions being formed of jersey knit stitches with one end of yarn in each stitch knit to a stitch height of 2.0 mm at said side sections and decreasing to 1.0 mm. adjacent said intermediate portions.

13. The knitted fabric bra of claim 12 characterized by said transition portions extending over approximately one-tenth of the length of said back section.

14. The knitted fabric bra of claim 11 characterized by said intermediate portions being knit with a 1×1 alternate positive needle selection with one yarn and a jersey needle selection with another yarn beginning at a knit stitch height of 1.0 mm. adjacent said transition portions and decreasing to a knit stitch height of 0.5 mm.

15. The knitted fabric bra of claim 14 characterized by said intermediate portions extending over approximately one-quarter of the length of said back section.

16. The knitted fabric bra of claim 11 characterized by said middle portion having two ends of yarn knit in a 1×1 alternate positive needle selection at a knit stitch height of 0.5 mm.

17. The knitted fabric bra of claim 16 characterized by said middle portion extending over approximately three-tenths of the length of said back section.

18. The knitted fabric bra of claim 11 characterized by each transition portion extending over approximately one-tenth of the length of said back section, each said intermediate portion extending over approximately one-quarter of said back section, and said middle portion extending over approximately three-tenths of the length of said back section.

19. A knit fabric bra comprising a length of circular knit material flattened into a double ply fabric having ends secured together to form a torso encircling main body portion having rounded top and bottom edges, a pair of lengths of circular knit material flattened into double ply fabrics having ends secured to said main body portion to form shoulder straps having rounded side edges, said main body portion has a pair of enlarged, relatively loosely knit, relatively highly resiliently stretchable breast pockets, relatively tightly knit, relatively non-stretchable under-sections below said breast pockets, relatively tightly knit, relatively non-stretchable side sections extending from said breast pockets, a moderately loosely knit, moderately resiliently stretchable back section, a moderately resiliently stretchable, relatively short, front section between said breast pockets, and said ends of said main body portion length of fabric being secured together in said front section.

20. The knitted fabric bra of claim 19 characterized by said length of circular knit material comprising stretch yarn having a spandex core wrapped with textured stretch nylon filament yarn.

21. The knitted fabric bra of claim 20 characterized by the yarn in said breast pockets, under-sections, side sections and back section comprising a 20 denier spandex core yarn wrapped with a 70 denier textured stretch nylon filament yarn containing 72 filaments and the stretch yarn in said front section being a 20 denier spandex core yarn wrapped with a 30 denier textured stretch nylon filament yarn containing 34 filaments.

22. A knit fabric bra comprising a length of circular knit material flattened into a double ply fabric having ends secured together to form a torso encircling main body portion having rounded top and bottom edges, a pair of lengths of circular knit material flattened into double ply fabrics having ends secured to said main body portion to form shoulder straps having rounded side edges, a pair of breast pockets in said main body portion, under-sections below said breast pockets, side sections extending from said breast pockets, a back section extending between said side portions, and a front section extending between said breast pockets, and said shoulder strap lengths of circular knit material flaring outwardly to ends secured to the main body portion at said breast pockets to form continuations of said breast pockets.

23. The knitted fabric bra of claim 19 characterized by said shoulder strap lengths of circular knit material flaring outwardly to ends secured to the main body portion at said breast pockets to form continuations of said breast pockets.

24. A knit fabric bra comprising a length of circular knit material flattened into a double ply fabric having ends secured together to form a torso encircling main body portion having rounded top and bottom edges, a pair of lengths of circular knit material flattened into double ply fabrics having ends secured to said main body portion to form shoulder straps having rounded side edges, said main body portion having a pair of enlarged, relatively loosely knit, relatively highly resiliently stretchable breast pockets, and each of said shoulder strap lengths of circular knit material having a relatively wide front end that is connected to said breast pocket, followed by a front section that tapers inwardly from said front end to a relatively narrow straight section that flares to a relatively wider straight section, followed by a tapered rear section that flares to an end that is connected to said main body portion, said inward tapering of said front section resulting in an outward flaring from said relatively narrow straight section to said front end to provide a continuation of said breast pocket.

25. The knitted fabric bra of claim 24 characterized by said front section being knit at a 1×1 positive needle selection at two feeds and a jersey knit needle selection at two feeds with one end of yarn in each stitch and a knit stitch height progressing from 2.5 mm. at said front end to 2.0 mm., followed by said relatively narrow straight section knit in a 1×3 random needle selection with one end of yarn in each stitch, at a knit stitch height initially tapering from 2.0 to 0.5 mm., followed by flaring into said relatively wider straight section knit in a 1×1 and 1×3 alternating positive needle selection with one end of yarn in each stitch and a knit stitch height of 0.5 mm., said flared rear section being knit in a 1×1 needle selection with one end of yarn in each stitch and at a knit stitch height increasing from 0.5 mm. to 1.5 mm.

26. The knitted fabric bra of claim 25 characterized by said front section extending approximately one-eighth of the length of said length of shoulder strap material, said relatively narrow straight section extending approximately one-half the length of said length of shoulder strap material, said relatively wider straight section extending approximately one-quarter of the length of said length of shoulder strap material and said rear section extending approximately one-eighth of the length of said length of shoulder strap material.

27. The knitted fabric bra of claim 24 characterized by said length of shoulder strap material comprising stretch yarn having a spandex core wrapped with textured stretch nylon filament yarn.

28. The knitted fabric bra of claim 27 characterized by said stretch yarn in said front section having a 20 denier spandex core wrapped with a 70 denier stretch nylon filament yarn containing 72 filaments, the stretch yarn in said relatively narrow straight section, in said relatively wider straight section and in said rear section having a 20 denier spandex core wrapped by a 23 denier textured stretch nylon filament yarn containing 28 filaments.

29. The knitted fabric bra of claim 26 characterized by said length of shoulder strap material comprising stretch yarn having a spandex core wrapped with textured stretch nylon filament yarn.

30. The knitted fabric bra of claim 29 characterized by said stretch yarn in said front section having a 20 denier spandex core wrapped with a 70 denier stretch nylon filament yarn containing 72 filaments, the stretch yarn in said relatively narrow straight section, in said relatively wider straight section and in said rear section having a 20 denier spandex core wrapped by a 23 denier textured stretch nylon filament yarn containing 28 filaments.

* * * * *